US010994752B2

(12) United States Patent
Stojc et al.

(10) Patent No.: US 10,994,752 B2
(45) Date of Patent: May 4, 2021

(54) LOCK MECHANISM FOR IMPROVED DOOR PANEL SEAL

(71) Applicant: Westinghouse Air Brake Technologies Corporation, Wilmerding, PA (US)

(72) Inventors: Andre Stojc, Ile Bizard (CA); Daniel Filion, Mirabel (CA)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 304 days.

(21) Appl. No.: 16/088,978

(22) PCT Filed: Apr. 5, 2017

(86) PCT No.: PCT/US2017/026057
§ 371 (c)(1),
(2) Date: Sep. 27, 2018

(87) PCT Pub. No.: WO2017/176831
PCT Pub. Date: Oct. 12, 2017

(65) Prior Publication Data

US 2019/0176856 A1 Jun. 13, 2019

Related U.S. Application Data

(60) Provisional application No. 62/318,824, filed on Apr. 6, 2016.

(51) Int. Cl.
*B61D 19/02* (2006.01)
*B61D 19/00* (2006.01)
(Continued)

(52) U.S. Cl.
CPC ..... *B61D 19/02* (2013.01); *B61D 19/005* (2013.01); *E05F 15/638* (2015.01); *E05F 15/652* (2015.01); *E05Y 2900/51* (2013.01)

(58) Field of Classification Search
CPC ..... B61D 19/005; B61D 19/02; E05F 15/638; E05F 15/652; E05Y 2900/51
See application file for complete search history.

(56) References Cited

U.S. PATENT DOCUMENTS 3,745,705 A 7/1973 Reddy
4,035,956 A 7/1977 Newson
(Continued)

FOREIGN PATENT DOCUMENTS

CN 1348882 A 5/2002
CN 1748953 A 3/2006
(Continued)

OTHER PUBLICATIONS

Extended European Search Report dated Nov. 13, 2019 for corresponding EP application 17779707.3; 12 pages.
(Continued)

*Primary Examiner* — Mark T Le
(74) *Attorney, Agent, or Firm* — Christopher R. Carroll; The Small Patent Law Group LLC

(57) ABSTRACT

A door operator system for moving a door of a vehicle between open and closed positions includes a track defined in a base, the track having a curved portion at an end thereof; a drive bracket configured to suspend the door from the base, the drive bracket being slidably movable along the track between an open position and a closed position adjacent to the curved portion; a drive mechanism configured to cause movement of the drive bracket between the open and closed positions; and a locking system configured to retain the drive bracket in the closed position. When the drive bracket is in the closed position, the curved portion engages a cam follower of the locking system to retain the cam follower in a locked position that is over center with respect to a plane perpendicular to the track and a plane parallel to the track.

23 Claims, 10 Drawing Sheets

(51) Int. Cl.
*E05F 15/638* (2015.01)
*E05F 15/652* (2015.01)

(56) References Cited

U.S. PATENT DOCUMENTS

| | | | | |
|---|---|---|---|---|
| 4,364,454 | A | 12/1982 | Glaser et al. | |
| 5,148,631 | A | 9/1992 | Bayard et al. | |
| 5,755,060 | A | 5/1998 | Zweili | |
| 5,893,236 | A * | 4/1999 | Krbec | B61D 19/008 49/118 |
| 6,032,416 | A | 3/2000 | Springer et al. | |
| 6,076,589 | A * | 6/2000 | Hormann | E05D 15/24 160/201 |
| 6,134,838 | A | 10/2000 | Reddy | |
| 6,446,389 | B1 | 9/2002 | Heffner et al. | |
| 6,539,669 | B1 | 4/2003 | Heidrich et al. | |
| 6,640,388 | B2 | 11/2003 | Covert et al. | |
| 6,662,501 | B2 | 12/2003 | Pagowski et al. | |
| 6,684,567 | B2 | 2/2004 | Heidrich et al. | |
| 6,718,694 | B2 | 4/2004 | Stojc et al. | |
| 7,228,804 | B2 | 6/2007 | Stojc et al. | |
| 10,119,319 | B2 * | 11/2018 | Ritt | E05D 15/1068 |
| 10,328,955 | B2 * | 6/2019 | Yamaguchi | E05D 13/00 |
| 10,711,509 | B2 * | 7/2020 | Shi | E05F 15/652 |
| 2002/0184823 | A1 | 12/2002 | Heffner et al. | |
| 2004/0211121 | A1 | 10/2004 | Inage | |

FOREIGN PATENT DOCUMENTS

| | | | |
|---|---|---|---|
| CN | 101117876 | A | 2/2008 |
| CN | 201391153 | Y | 1/2010 |
| CN | 102678020 | A | 9/2012 |
| CN | 203640550 | U | 6/2014 |
| CN | 205314736 | U | 6/2016 |
| CN | 205819209 | U | 12/2016 |
| EP | 0255991 | A2 | 2/1988 |
| EP | 2362046 | A1 | 8/2011 |
| WO | 2017176831 | A1 | 10/2017 |

OTHER PUBLICATIONS

First Office Action dated Dec. 18, 2019 for corresponding CN Application No. 201780029347.0 (6 pages).

English translated version of the First Office Action dated Dec. 18, 2019 for corresponding CN Application No. 201780029347.0 (6 pages).

* cited by examiner

LOCK MECHANISM FOR IMPROVED DOOR PANEL SEAL

CROSS-REFERENCE TO RELATED APPLICATION

The present application claims priority to U.S. Provisional Patent Application No. 62/318,824, filed on Apr. 6, 2016, which is hereby incorporated by reference in its entirety.

BACKGROUND OF THE INVENTION

Field of the Invention

The present invention relates generally to a door operator for a transit vehicle door assembly and, in particular, to a door operator that incorporates an overcenter locking mechanism for retaining the doors in the closed position.

Description of Related Art

Overcenter locking mechanisms are used in door systems for transit vehicles as a cost effective mechanism for locking the passenger doors upon their full closure. Various implementations of such overcenter locks have been designed and produced.

Existing overcenter locks for rail transit applications are typically unable to provide much compression between the leading edges of the bi-parting doors or between a single panel door and its associated door frame. As a result, door panels are not sufficiently tightly closed and, therefore, cannot achieve optimum noise and weather sealing. This is because a large amount of torque is required to actuate the lock mechanism from the unlocked to the locked state. Further, too much door panel compression induces friction in the lock mechanism because the reaction force to this panel compression is provided by the lock mechanism itself. When it is required to unlock the door, the drive mechanism requires substantial torque to overcome the friction and reliably unlock the door.

Bi-parting outside transit doors are known in the art as shown, for example, in U.S. Pat. No. 7,228,804 to Stojc et al. and U.S. Pat. No. 6,032,416 to Springer et al. Bi-parting plug doors are known in the art as shown, for example, in U.S. Pat. Nos. 6,539,669 and 6,684,567 to Heidrich et al.

SUMMARY OF THE INVENTION

According to one example of the present disclosure, a locking system for a rail transit single-panel door moving along the wall of a transit vehicle in a longitudinal direction substantially parallel to the wall, the door being slidably suspended adjacent the wall and a door opening, is provided. The locking system comprising a door operator system comprising a base for mounting a door drive system to the vehicle, the base having first and second longitudinal tracks for guiding the sliding door, the first track being curved adjacent the door closed end position and the second track being straight; a cam-follower drive-arm supporting a track-engaging cam-follower for engaging the first track and supporting a track engaging roller for engaging the second track; a linear drive mechanism mounted substantially parallel to the tracks on the base, the linear drive mechanism including a linearly driven member, the linearly driven member including a driving pivot; the cam-follower drive arm attached to the driving pivot at a drive force receiving end, the cam-follower drive-arm including a driven pivot at a drive force communicating end, a locking arm and the cam-follower pivotally attached to the driven pivot, the locking arm being attached to a drive arm link, a drive bracket connected between the drive arm link and the door whereby linear motion of the linear driven member and driving pivot causes motion of the door; a track end bumper positioned beyond the door closed end of the first track arranged to urge rotation of the locking arm to move the free end thereof perpendicular to the longitudinal direction, a spring at the end of the curved portion of the first track to bias the track-engaging cam-follower toward the end of the first track, such that the cam-follower drive-arm and locking arm are in overcenter positions when the door has been moved to the closed and locked position.

According to the example, in the locked position the driven pivot crosses a first overcenter plane being perpendicular to the longitudinal direction, and the driven pivot crosses a second overcenter plane being parallel to the longitudinal direction.

The linear drive may further include a motor; a drive screw having rotary power connection to the motor, at least one of the motor and the drive screw being mounted on the base; and the linearly driven member further including a drive nut engaging the drive screw to be driven thereby, whereby rotation of the drive screw imparts the linear motion to the drive nut and, hence, the drive arm and locking arm.

The drive arm may have a spur at its drive force communicating end being configured to mate with an abutment mounted adjacent the first track.

According to another example of the present disclosure, a locking system for a bi-parting door moving along the wall of a transit vehicle in a longitudinal direction substantially parallel to the wall, the door being slidably suspended adjacent the wall and a door opening, is provided. The locking system comprises a door operator system comprising a base for mounting a door drive system to the vehicle, the base having first and second sets of longitudinal tracks for guiding the sliding door, the first set of tracks being curved adjacent the door closed end position and the second set of tracks being straight; cam-follower drive-arms supporting track-engaging cam-followers for engaging the first set of tracks and supporting track-engaging rollers for engaging the second set of tracks; linear drive mechanisms mounted substantially parallel to the tracks on the base, the linear drive mechanism including linearly driven members moving in opposite longitudinal directions, the linearly driven members including driving pivots; the cam-follower drive arms attached to the driving pivots at a drive force receiving end, the cam-follower drive-arm including driven pivots at a drive force communicating ends, locking arms and the cam-followers pivotally attached to the driven pivots, the locking arms being attached to drive arm links, drive brackets connected between the drive arm links and the doors whereby linear motion of the linear driven members and driving pivots causes motion of the doors; track end bumpers positioned beyond the door closed end of the first set of tracks arranged to urge rotation of the locking arms to move the free end thereof perpendicular to the longitudinal direction, springs at the end of the curved portions of the first set of tracks to bias the track-engaging cam-followers toward the end of the tracks, such that the cam-follower drive-arms and locking arms are in overcenter positions when the door has been moved to the closed and locked position.

According to the example, in the locked position the driven pivots cross first overcenter planes being perpendicular to the longitudinal direction and the driven pivots cross second overcenter planes being parallel to the longitudinal direction.

The linear drive may further include a motor; two drive screws having rotary power connection to the motor, at least one of the motor and the drive screws being mounted on the base; and the linearly driven members further including a drive nut engaging the drive screws to be driven thereby, whereby rotation of the drive screws impart the linear motion to the drive nuts and, hence, the drive arms and locking arms.

The drive arms may have spurs at their drive force communicating end respectively being configured to mate with abutments mounted adjacent the first tracks.

According to another example of the present disclosure, a door operator system for moving a door of a transit vehicle along a door opening between open and closed positions is provided. The door operator system comprises: a base configured to be mounted on the transit vehicle above the door opening, the base comprising a first set of tracks defined therein, a first track of the first set of tracks having a curved portion at an end thereof; a drive bracket slidably mounted on the first set of tracks of the base, the drive bracket being configured to suspend the door from the base, the drive bracket being slidably movable along the first set of tracks between a door open position and a door closed position adjacent to the curved portion of the first track; a drive system disposed on the base, the drive system comprising: a linear drive mechanism configured to be activated to cause movement of the drive bracket between the door open position and the door closed position; and a linearly driven member connected to the linear drive mechanism to be driven by the linear drive mechanism in opposing directions along a second track of the first set of tracks, the linearly driven member being operably connected to the drive bracket; a locking system connecting the drive bracket to the linearly driven member and configured to retain the drive bracket in the door closed position, the locking system comprising: a cam-follower drive arm pivotably connected to the linearly driven member at a first end of the cam-follower drive arm; a track-engaging cam follower connected to a second end of the cam-follower drive arm, the track-engaging cam follower being movably disposed in the first track of the first set of tracks to be movable along the first track; and a locking arm pivotably connected to the second end of the cam-follower drive arm, the locking arm being operatively connected to the drive bracket. When the drive bracket is in the door closed position, the curved portion of the first track of the first set of tracks engages the track-engaging cam follower such that the track-engaging cam follower is retained in a locked position that is overcenter with respect to a first overcenter plane perpendicular to the first set of tracks extending through a pivotal connection between the cam-follower drive arm and the linearly driven member and with respect to a second overcenter plane parallel to the first set of tracks extending along a surface of the first track of the first set of tracks.

According to another example of the present disclosure, a door operator system for moving a pair of doors of a transit vehicle in opposing directions along a door opening between open and closed positions is provided. The door operator system comprises: a base configured to be mounted on the transit vehicle above the door opening, the base comprising a first set of tracks and a second set of tracks defined therein, a first track of the first set of tracks having a first curved portion at an end thereof and a first track of the second set of tracks having a second curved portion formed at an end thereof; a first drive bracket slidably mounted on the first set of tracks and a second drive bracket slidably mounted on the second set of tracks, each of the drive brackets being configured to suspend a respective one of the doors from the base, the first drive bracket being slidably movable along the first set of tracks and the second drive bracket being slidably movable along the second set of tracks between respective door open positions and respective door closed positions adjacent to a respective one of the curved portions of the respective first tracks; a drive system disposed on the base, the drive system comprising: a linear drive mechanism configured to be activated to cause movement of the drive brackets between the door open positions and the door closed positions; and a first linearly driven member and a second linearly driven member connected to the linear drive mechanism to be driven by the linear drive mechanism in opposing directions along a respective second track of the first and second set of tracks, the linearly driven members being operably connected to a respective one of the drive brackets; a first locking system connecting the first drive bracket to the first linearly driven member and configured to retain the first drive bracket in the door closed position and a second locking system connecting the second drive bracket to the second linearly driven member and configured to retain the second drive bracket in the door closed position, each of the first and second locking systems comprising: a cam-follower drive arm pivotably connected to the respective linearly driven member at a first end of the cam-follower drive arm; a track-engaging cam follower connected to a second end of the respective cam-follower drive arm, the track-engaging cam follower being movably disposed in the respective first track to be movable along the respective first track; and a locking arm pivotably connected to the second end of the respective cam-follower drive arm, the locking arm being operably connected to the respective drive bracket. When the respective drive bracket is in the door closed position, the respective curved portion of the respective first track engages the respective track-engaging cam follower such that the respective track-engaging cam follower is retained in a locked position that is overcenter with respect to a first overcenter plane perpendicular to the respective set of tracks extending through a respective pivotal connection between the respective cam-follower drive arm and the respective linearly driven member and with respect to a second overcenter plane parallel to the respective set of tracks extending along a surface of the respective first track.

According to another example of the present disclosure, a door assembly for a transit vehicle having a door opening formed in a wall of the transit vehicle is provided. The door assembly comprises: a pair of doors disposed adjacent to the wall; and a door operator system described in the preceding paragraph, the door operator system being configured to move the pair of doors in opposing directions along the door opening between open and closed positions.

According to another example of the present disclosure, a door operator system for moving a door of a transit vehicle along a door opening between open and closed positions is provided. The door operator system comprises: a base comprising a track defined therein, the track having a curved portion at an end thereof; a drive bracket slidably mounted to the track, the drive bracket being configured to suspend the door from the base, the drive bracket being slidably movable along the track between an door open position and door closed position adjacent to the curved portion; a linear drive mechanism operably connected to the drive bracket, the linear drive mechanism being configured to be activated to cause movement of the drive bracket between the door open position and the door closed position; and a locking system connecting the drive bracket to the linear drive mechanism and configured to retain the drive bracket in the door closed position. When the drive bracket is in the door closed position, the curved portion of the track engages a track-engaging cam follower of the locking system such that the track-engaging cam follower is retained in a locked position that is overcenter with respect to a first overcenter plane perpendicular to the track extending through a connection between the locking system and the linear drive mechanism and with respect to a second overcenter plane parallel to the track extending along a surface of the track.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
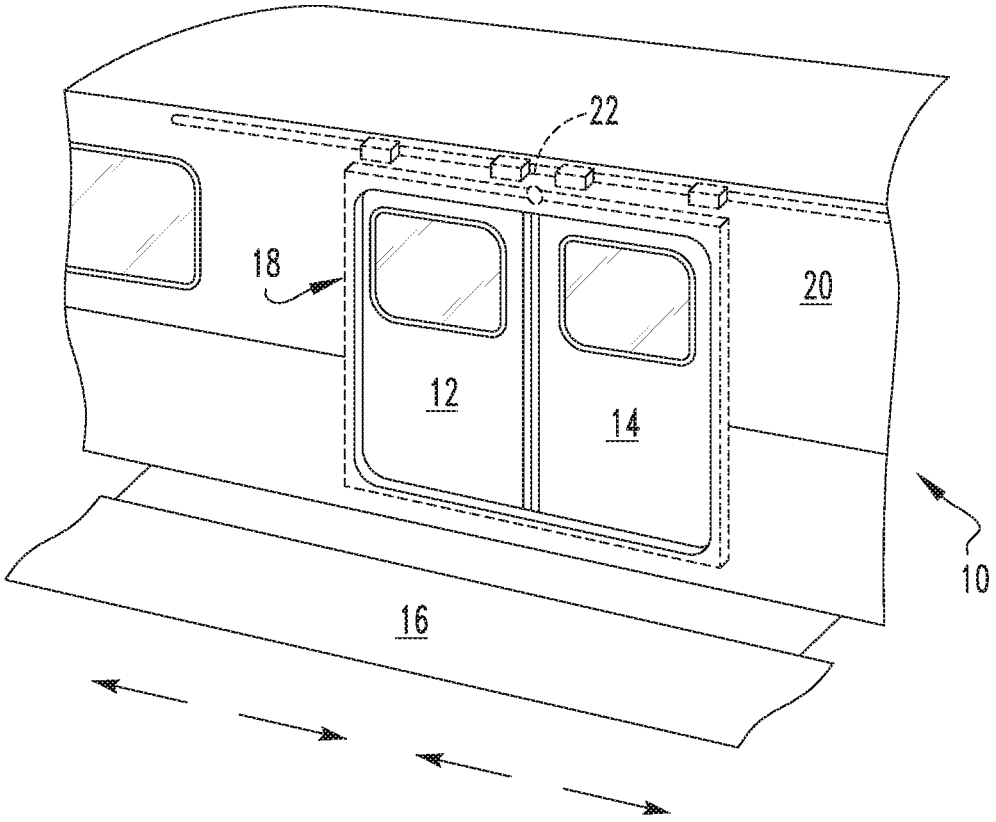
FIG. 1 is a perspective view of a portion of a transit vehicle having a bi-parting door assembly according to an example of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

With reference to FIG. 1, a transit vehicle 10, such as a subway car, trolley car, other rail transit vehicle, or similar vehicle, is shown according to an example of the present disclosure. The vehicle 10 includes a door assembly that includes a pair of outside bi-parting doors 12, 14 and a door operator system 22 according to an example of the present disclosure. As shown, the doors 12, 14 are closed and the transit vehicle 10 is stopped at a platform 16. The doors 12, 14 cover a passenger portal or opening 18 formed in a wall 20 of the transit vehicle 10. The doors 12, 14 are disposed adjacent to the wall 20 and are slidably suspended from the door operator system 22, which is disposed on the wall 20 above the door opening 18. The door operator system 22 moves the pair of doors 12, 14 in opposing directions along the door opening 18 between open and closed positions. The door operator system 22 includes a drive system 24, 26, 28, 30, 32, 34 and a locking system 36, 38, 42C, 42L, 44C, 44L, 46, 48, 50, 52, 58, 60, 62, 64 for moving the door between the open and closed positions. According to another example of the present disclosure, only a single door 12 may be provided to the opening 18. The door operator system 22 moves the single door 12 between the open and closed positions.

With reference to FIGS. 2-7, the door operator system 22 is shown according to an example of the present disclosure. The door operator system 22 is configured to move a door 12 or a pair of doors 12, 14 of the transit vehicle 10 between open and closed positions. The door operator system 22 includes a base 40 that is configured to be mounted on the transit vehicle 10 above the door opening 18. The base 40 includes a first set of tracks 42L, 42M and a second set of tracks 44L, 44M defined therein. The tracks 42L, 42M, 44L, 44M of the first and second set of tracks are arranged parallel to each other within the base 40 and extending in a longitudinal or horizontal direction of the base 40, i.e., in the open/close direction of the doors 12, 14. A first track 42L of the first set of tracks 42L, 42M has a first curved portion 42C at an end thereof and a first track 44L of the second set of tracks 44L, 44M has a second curved portion 44C formed at an end thereof. A first drive bracket 70 is slidably mounted on the first set of tracks 42L, 42M and a second drive bracket 72 is slidably mounted on the second set of tracks 44L, 44M. Each of the drive brackets 70, 72 is configured to suspend a respective one of the doors 12, 14 from the base 40. The first drive bracket 70 is slidably movable along the first set of tracks 42L, 42M and the second drive bracket 72 is slidably movable along the second set of tracks 44L, 44M between respective door open positions and respective door closed positions adjacent to a respective one of the curved portions 42C, 44C of the respective first tracks 42L, 44L.

Figure 2:
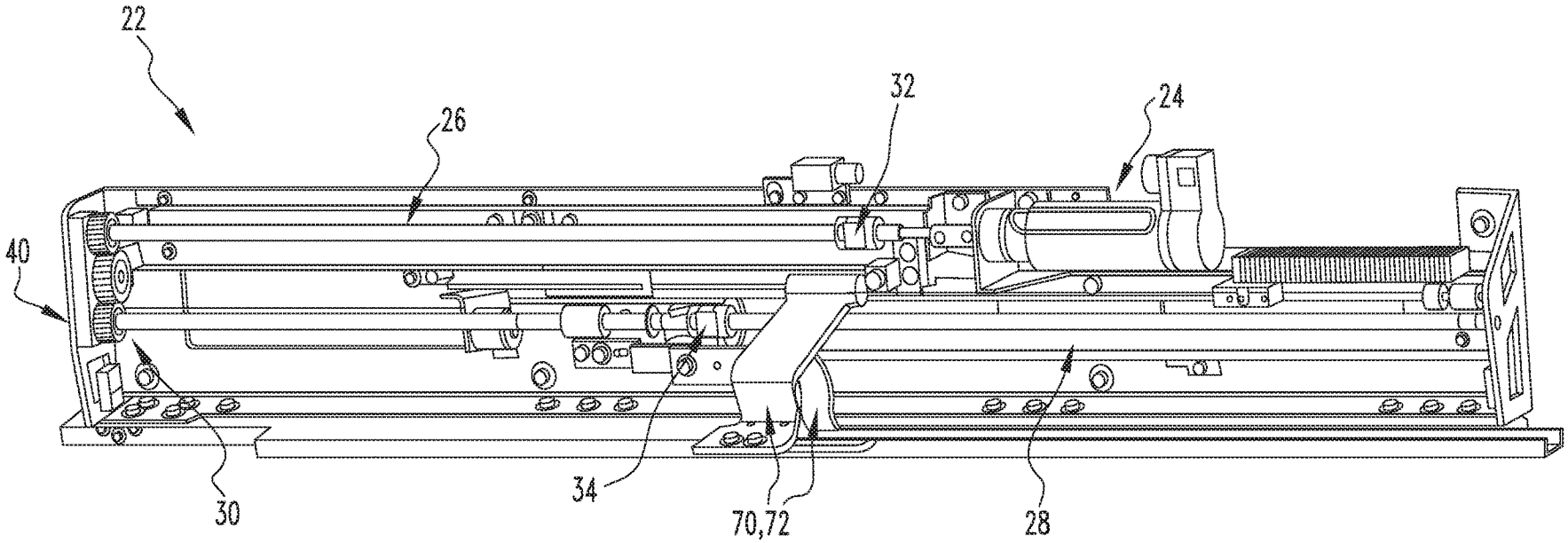
FIG. 2 is a perspective view of a door operator system according to an example of the present disclosure.
Figure 3:
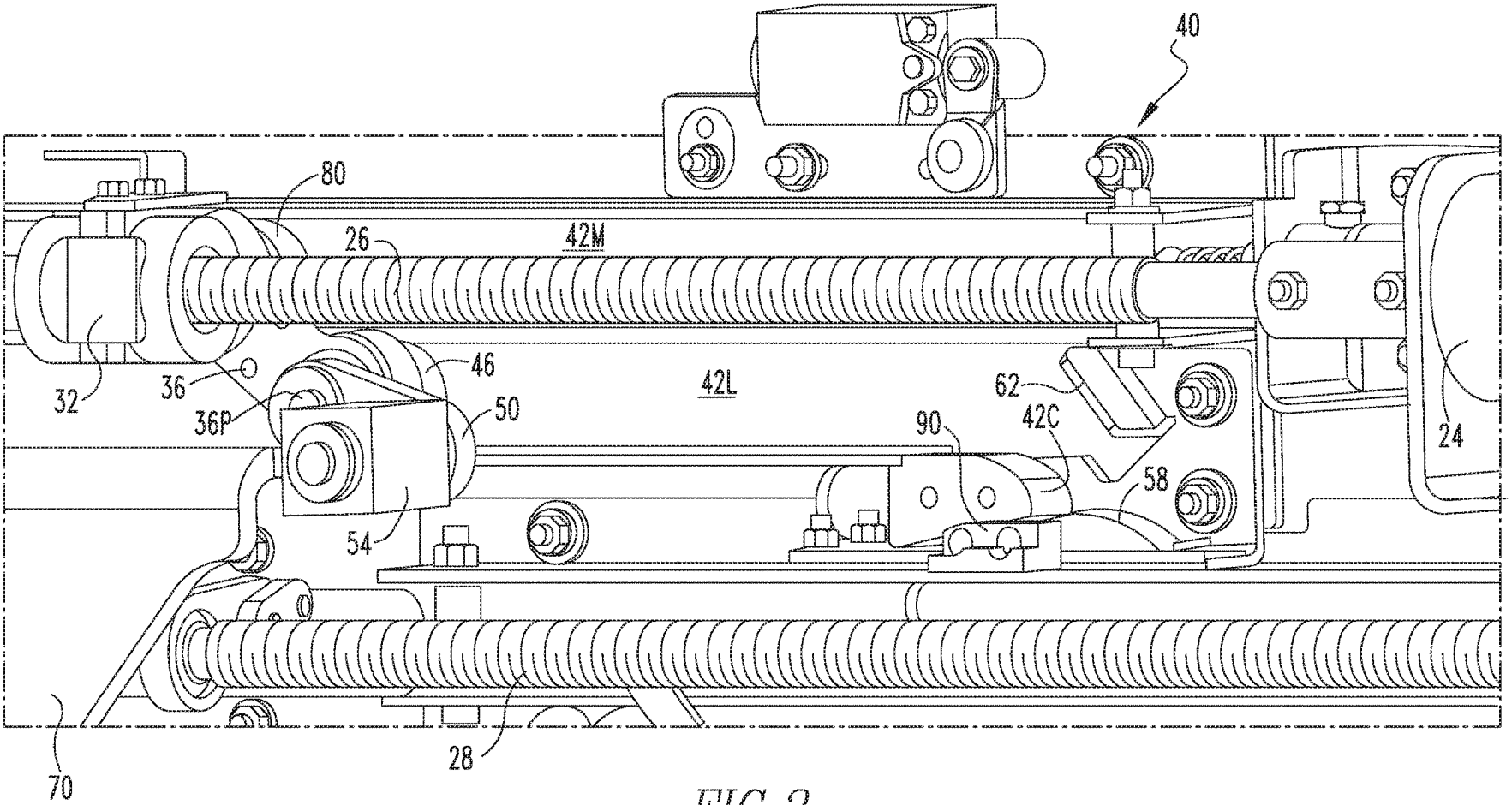
FIG. 3 is a partial perspective view of the door operator system of FIG. 2.
Figure 4:
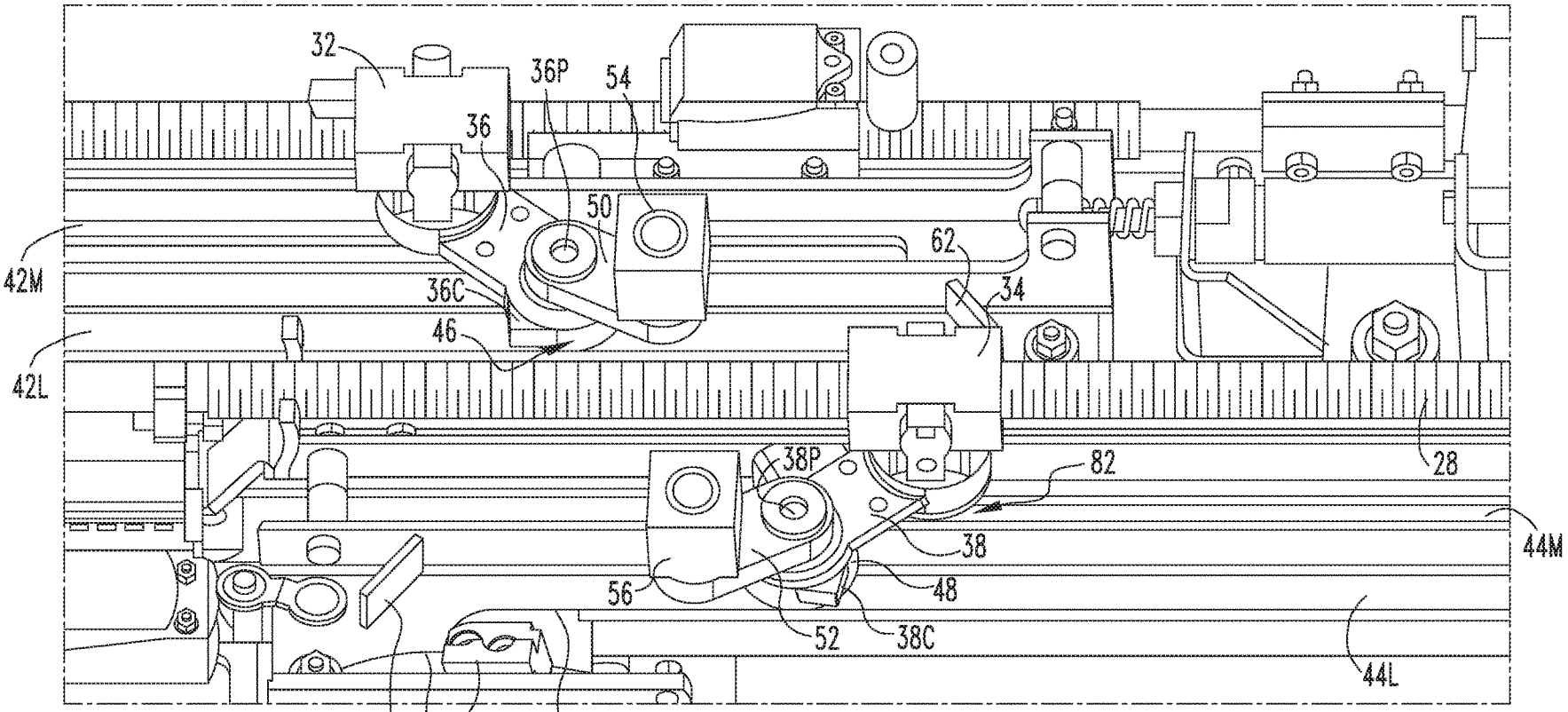
FIG. 4 is an alternate partial perspective view of the door operator system of FIG. 2.

As shown in FIGS. 2-4, the door operator system 22 includes a drive system 24, 26, 28, 30, 32, 34 disposed on the base 40. In particular, the drive system includes a linear drive mechanism 24, 26, 30, 28 that is activated, such as via a wired switch or an automated control system, to cause movement of the drive brackets 70, 72 between the respective door open positions and door closed positions. The drive system also includes a first linearly driven member 32 and a second linearly driven member 34 connected to the linear drive mechanism 24, 26, 30, 28 to be driven by the linear drive mechanism 24, 26, 30, 28 in opposing directions along a respective second track 42M, 44M of the first and second set of tracks 42L, 42M, 44L, 44M. As will be discussed further below, the first and second linearly driven members 32, 34 are operably connected to a respective one of the first and second drive brackets 70, 72.

As shown in FIGS. 2-4, according to the example of the present disclosure, the linear drive mechanism 24, 26, 30, 28 includes a motor 24, such as a reversible electric motor, a drive screw 26 having a rotary power connection to the motor 24 such that operation of the motor 24 drives rotation of the screw 26 about its longitudinal axis, a master to slave drive gear train 30 and connected to the drive screw 26, and a slave drive screw 28 connected to the master to slave drive gear train 30 such that the master to slave drive gear train 30 transmits rotation imparted to the drive screw 26 to the slave drive screw 28. As shown, the motor 24 is mounted and structurally secured on the base 40 and the drive screw 26 extends longitudinally alongside the second track 42M of the first set of tracks 42L, 42M. The master to slave drive gear train 30 is mounted to a side or end plate of the base 40 and the slave drive screw 28 extends longitudinally alongside the second track 44M of the second set of tracks 44L, 44M. It is to be appreciated that the drive screw 26 and the slave drive screw 28 may be structurally connected to the base 40 by a different mechanism and the motor 24 and the master to slave drive gear train 30 may not be directly connected or mounted on the base 40.

Figure 8:
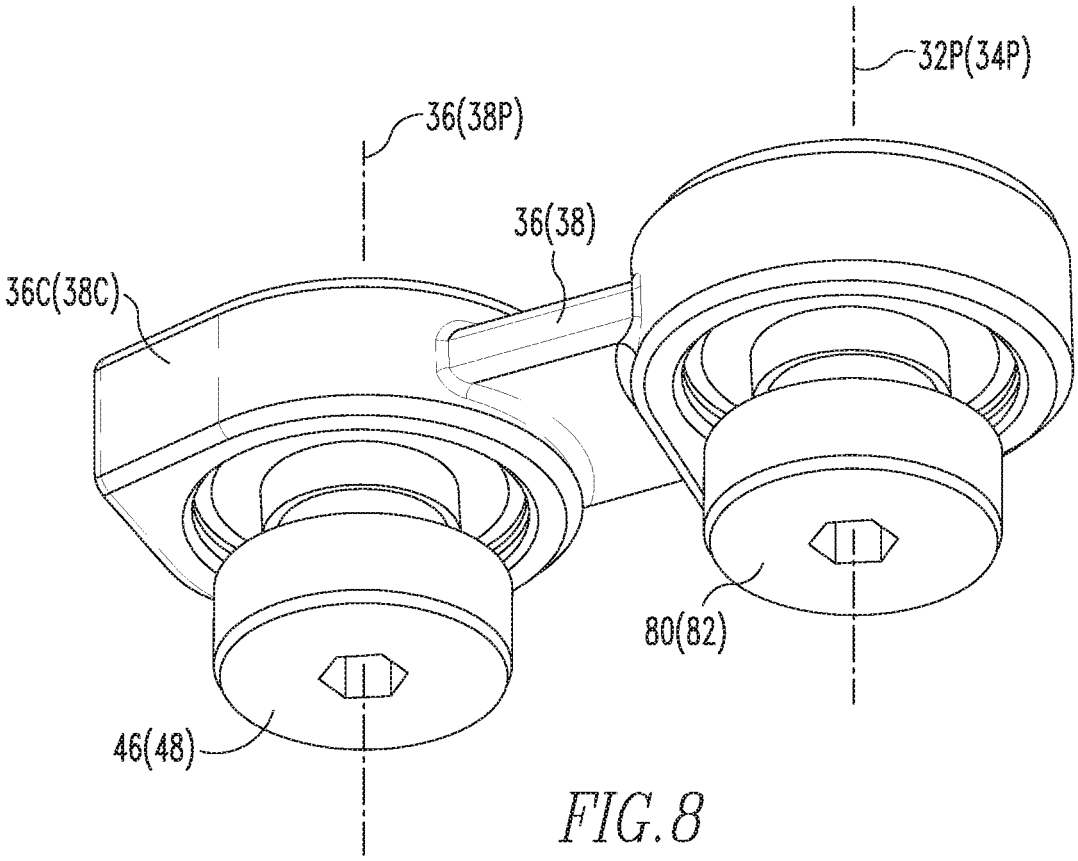
FIG. 8 a detailed perspective view of a cam-follower drive arm of the door operator system of FIG. 2.
Figure 9:
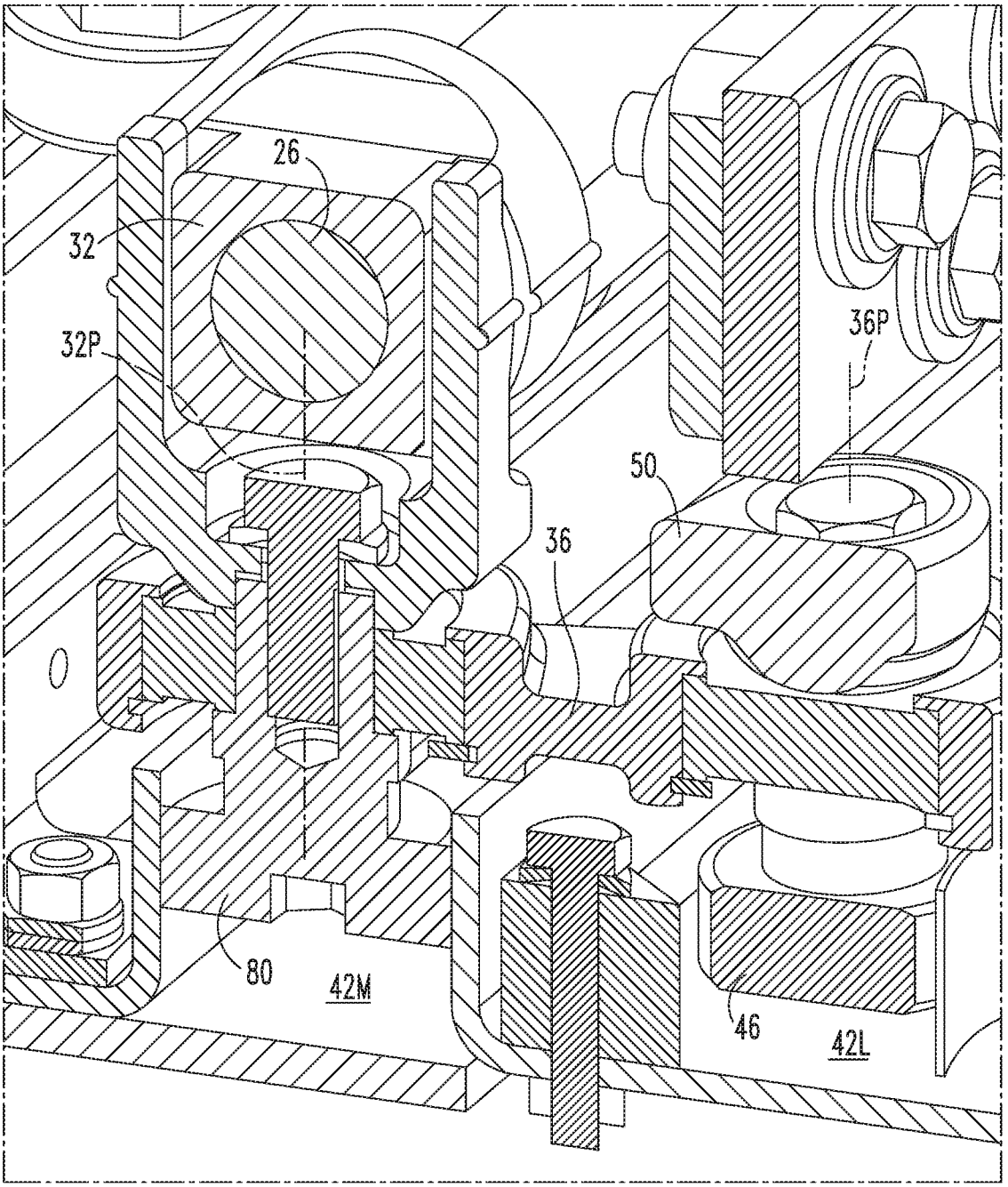
FIG. 9 is a perspective cross-sectional view of a master drive mechanism of the door operator system of FIG. 2.

The master to slave drive gear train 30 is connected to the drive screw 26 and the slave drive screw 28 is connected to the master to slave drive gear train 30 such that activation of the motor 24 actuates rotation of the drive screw 26 and of the slave drive screw 28 via the master to slave drive gear train 30. According to the example, the first and second linearly driven members 32, 34 are drive nuts 32, 34 threadably engaging a respective one of the drive screw 26 and the slave drive screw 28 such that rotation of the respective drive screw 26, 28 imparts linear motion to the drive nut 32, 34. The orientation of the threads and the rotation of the drive screws 26, 28 is such that the drive nuts 32, 34 always move in opposite directions. As shown in FIGS. 3, 8, and 9, a first roller 80 is operably connected the first drive nut 32 and engages the second track 42M of the first set of tracks 42L, 42M to guide movement of the drive nut 32 along the second track 42M. A second roller 82 is operably connected to the second drive nut 34 and engages the second track 44M of the second set of tracks 44L, 44M to guide movement of the drive nut 34 along the second track 44M.

With reference to FIGS. 3-7, the door operator system 22 further includes a first locking system 36, 46, 50 connecting the first drive bracket 70 to the first linearly driven member 32, which is configured to retain the first drive bracket 70 in the door closed position, and a second locking system 38, 48, 52 connecting the second drive bracket 72 to the second linearly driven member 34, which is configured to retain the second drive bracket 72 in the door closed position. Each of the first and second locking systems includes a cam-follower drive arm 36, 38 having a first end pivotably connected to the respective linearly driven member 32, 34 at a driving pivot 32P, 34P defined on the linearly driven member 32, 34 and oriented perpendicular to the respective drive screw 26, 28. As shown in FIGS. 3, 8, and 9, each roller 80, 82 may be connected to the respective linearly driven member 32, 34 at the driving pivot 32P, 34P via the respective cam-follower drive arm 36, 38.

With reference to FIGS. 3-9, each of the first and second locking systems also includes a track-engaging cam follower 46, 48 connected to a second end of the respective cam-follower drive arm 36, 38 at a driven pivot 36P, 38P defined on the respective cam-follower drive arm 36, 38 and oriented perpendicular to the respective drive screw 26, 28. The track-engaging cam followers 46, 48 are movably disposed in the respective first track 42L, 44L to be movable along the respective first track 42L, 44L such that the first tracks 42L, 44L guide the movement of the first and second locking systems and thereby of the first and second drive brackets 70, 72 between the open and closed positions via the track-engaging cam followers 46, 48. According to one example, as shown in FIGS. 3-9, the track-engaging cam followers 46, 48 may be rollers engaging the respective first tracks 42L, 44L.

As shown in FIGS. 3-7, each of the first and second locking systems further includes a locking arm 50, 52 pivotably connected to the respective cam-follower drive arm 36, 38 at the driven pivot 36P, 38P defined at the second end of the cam-follower drive arm 36, 38. Each locking arm 50, 52 is operably connected to the respective drive bracket 70, 72. According to one example, the first and second locking systems each further include a drive arm link 54, 56 pivotably connected to an end of the respective locking arm 50, 52 opposite to the driven pivot 36P, 38P that connects the respective drive bracket 70, 72 to the respective locking arm 50, 52. Each drive bracket 70, 72 may be directly and non-movably connected to a respective drive arm link 54, 56. As will be appreciated from the description provided below, each drive arm link 54, 56 is driven by the driving system 24, 26, 30, 28 to move along a line parallel to a respective one of the first and second set of tracks 42L, 42M, 44L, 44M and thus along a line parallel with the top edge of the doors 12, 14. The drive arm links 54, 56, drive brackets 70, 72, and doors 12, 14 may be mutually connected so as to move as a unit. As shown in FIGS. 1 and 2, the drive brackets 70, 72 may be attached to the doors 12, 14 near the edges of the doors 12, 14 where the doors 12, 14 meet in the closed position (leading edges of the doors 12, 14).

With reference to FIGS. 3-7, each of the first and second locking systems may further include a spring 58, 60 positioned at an end of the respective curved portion 42C, 44C of the respective first track 42L, 44L. Each spring 58, 60 is configured to engage the respective track-engaging cam follower 46, 48 when the respective drive bracket 70, 72 is in the door closed position to bias the respective track-engaging cam follower 46, 48 toward the respective curved portion 42C, 44C in order to retain the track-engaging cam follower 48 in a locked position, as will be discussed further below. As shown, the springs 58, 60 may be bowed leaf springs with ends fixed at locations spaced along the longitudinal direction of the tracks 42L, 42M, 44L, 44M. The springs 58, 60 are configured so as to initially resist motion of the track-engaging cam followers 46, 48 in the direction toward the door closed positions of the drive brackets 70, 72 until an intermediate position is reached and then urge the track-engaging cam followers 46, 48 toward the ends of the curved portions 42C, 44C.

With further reference to FIGS. 3-7, each of the first and second locking systems may also include a track end bumper 62, 64 proximate to the respective curved portion 42C, 44C of the respective first track 42L, 44L beyond the door closed position of the respective drive bracket 70, 72. Each track end bumper 62, 64 is configured to engage the respective track-engaging cam follower 46, 48 to cause the respective track-engaging cam follower 46, 48 to travel along the respective curved portion 42C, 44C toward the locked position in a direction having a component perpendicular to the longitudinal direction of the tracks 42L, 42M, 44L, 44M as the respective drive bracket 70, 72 approaches the door closed position and to retain the respective track-engaging cam follower 46, 48 in the locked position.

Figure 10:
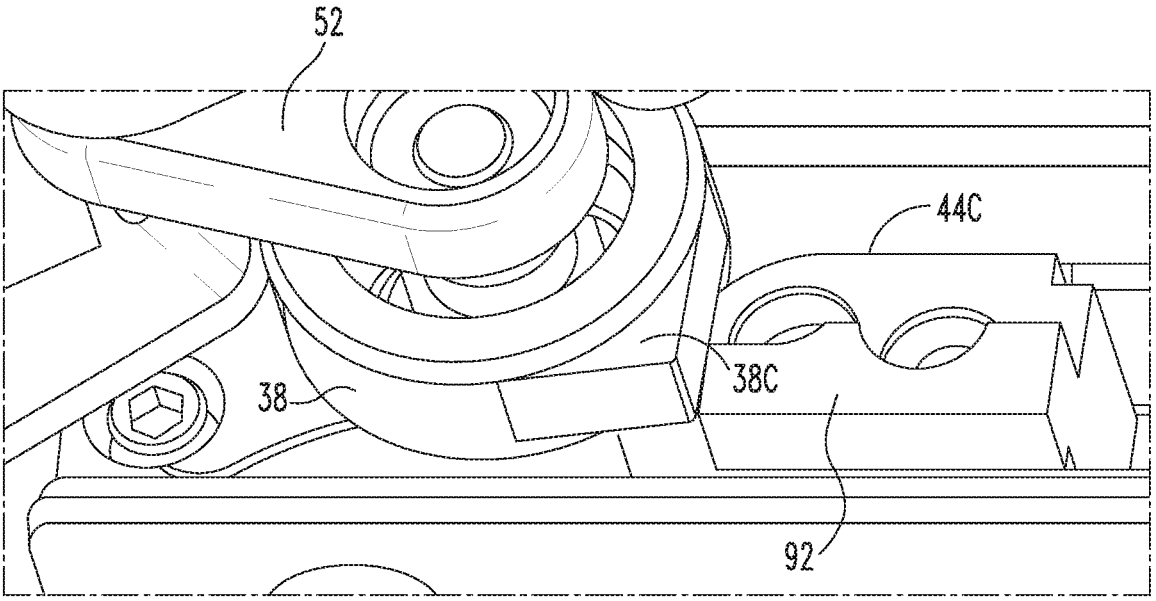
FIG. 10 is a detailed perspective view of a slave drive arm with a spur resting against an abutment in the door operator system of FIG. 2.

Additionally, with reference to FIGS. 3-10, each cam-follower drive arm 36, 38 may include a spur 36C, 38C at the second end thereof and each of the first and second locking systems may further comprise an abutment 90, 92. As shown in FIG. 10, when the respective track-engaging cam follower 46, 48 is in the locked position, the spur 36C, 38C is brought into engagement with the respective abutment 90, 92 to retain the respective track-engaging cam follower 46, 48 in the locked position.

FIGS. 3 and 4 provide a detailed view of the drive system and the first and second locking systems from two different perspectives while the doors 12, 14 are partially open. As the drive screws 26, 28 rotate due to activation of the motor 24, the drive nuts 32, 34 move linearly in a direction toward the respective door closed position. The rollers 80, 82 and the track-engaging cam followers 46, 48 connected to the drive nuts 32, 34 are driven in opposite directions guided by the respective sets of tracks 42L, 42M, 44L, 44M. Motion of the rollers 80, 82 is limited to a direction parallel to the drive screws 26, 28 whereas motion of the track-engaging cam followers 46, 48 is urged to follow the surface of the respective curved portions 42C, 44C of the first tracks 42L, 44L in a direction non-parallel to the drive screws 26, 28 as the drive brackets 70, 72 approach the door closed position.

Figure 5:
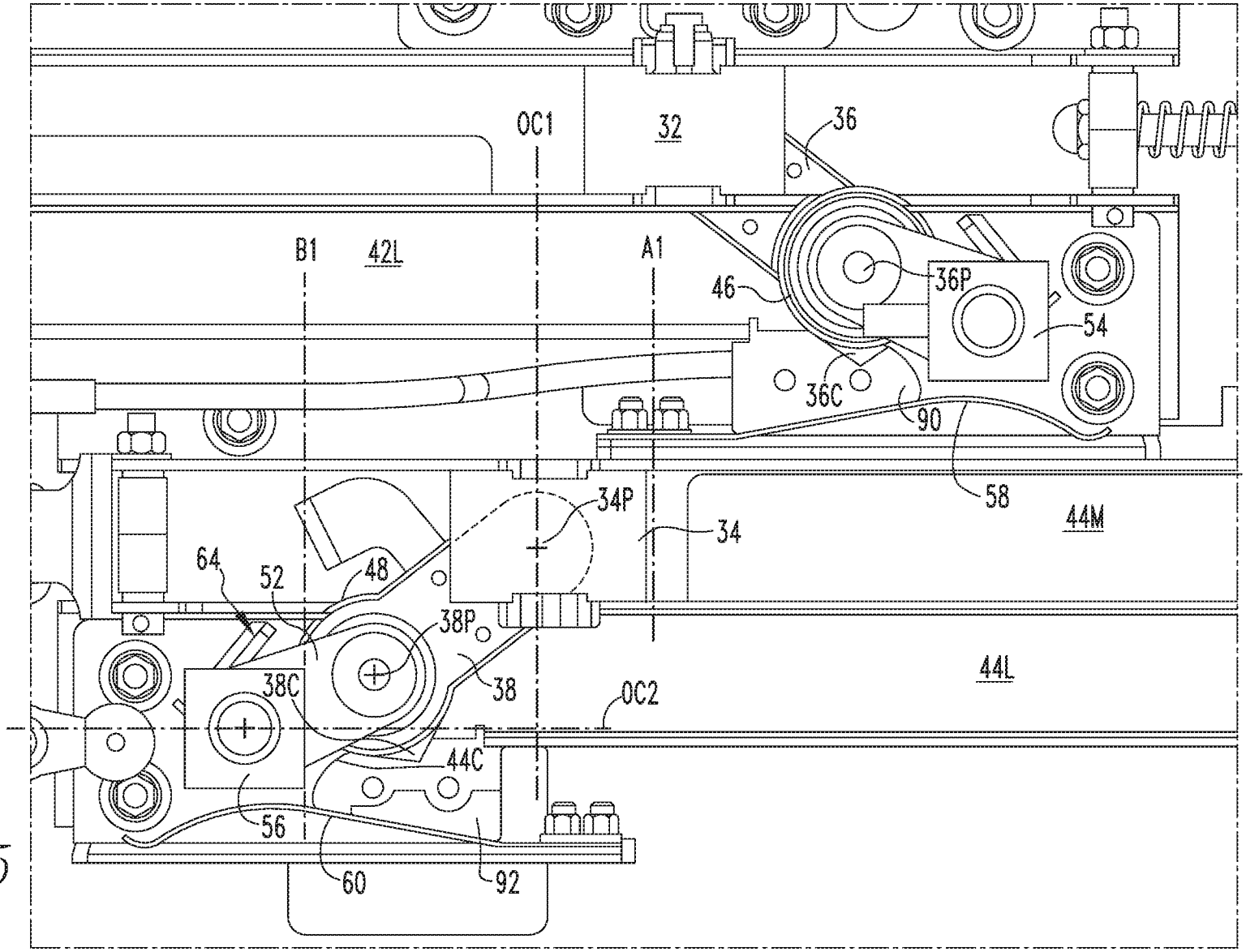
FIG. 5 is a partial view of the door operator system of FIG. 2 in a partially open and unlocked condition.
Figure 6:
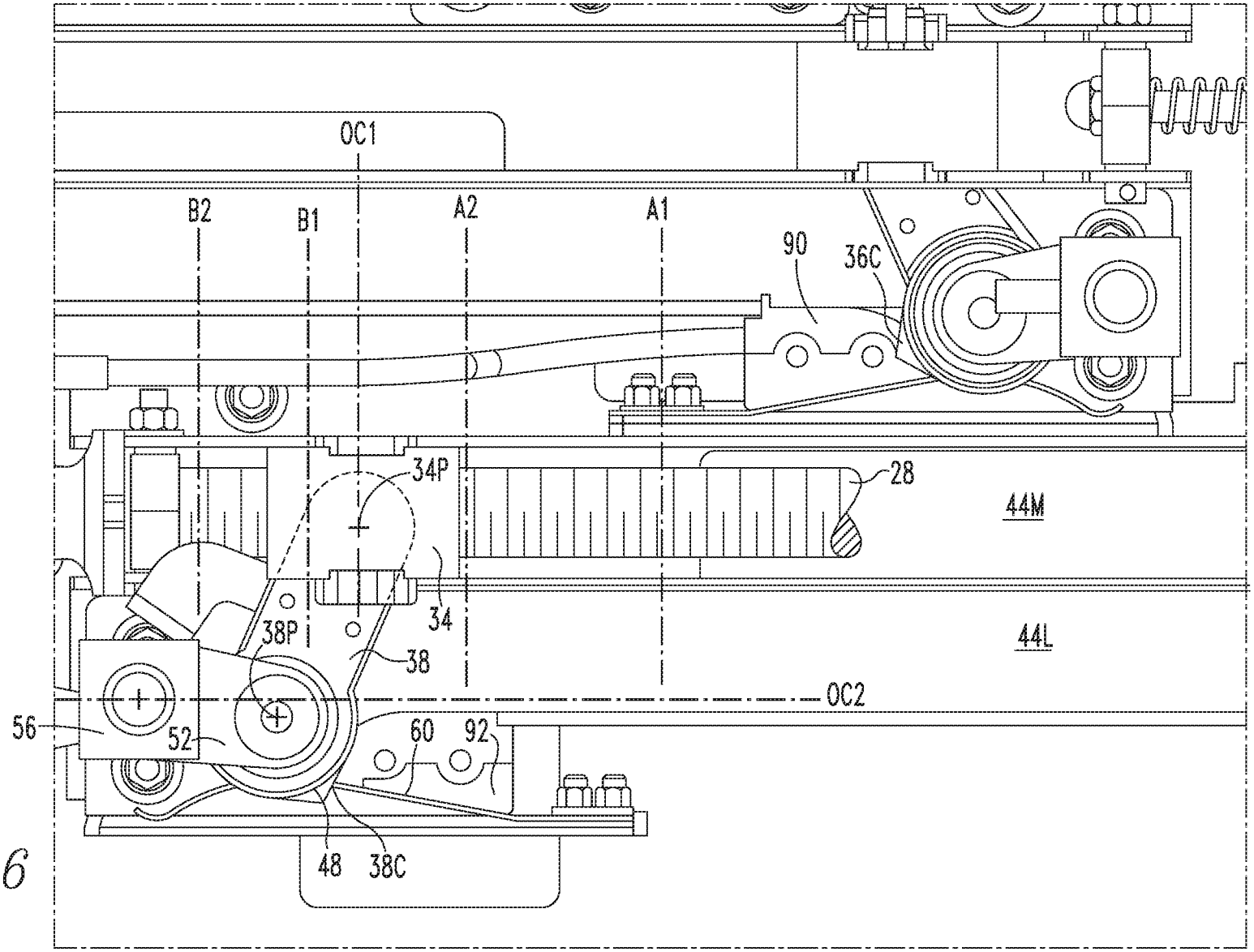
FIG. 6 is a partial view of the door operator system of FIG. 2 in a closed and partially locked condition.
Figure 7:
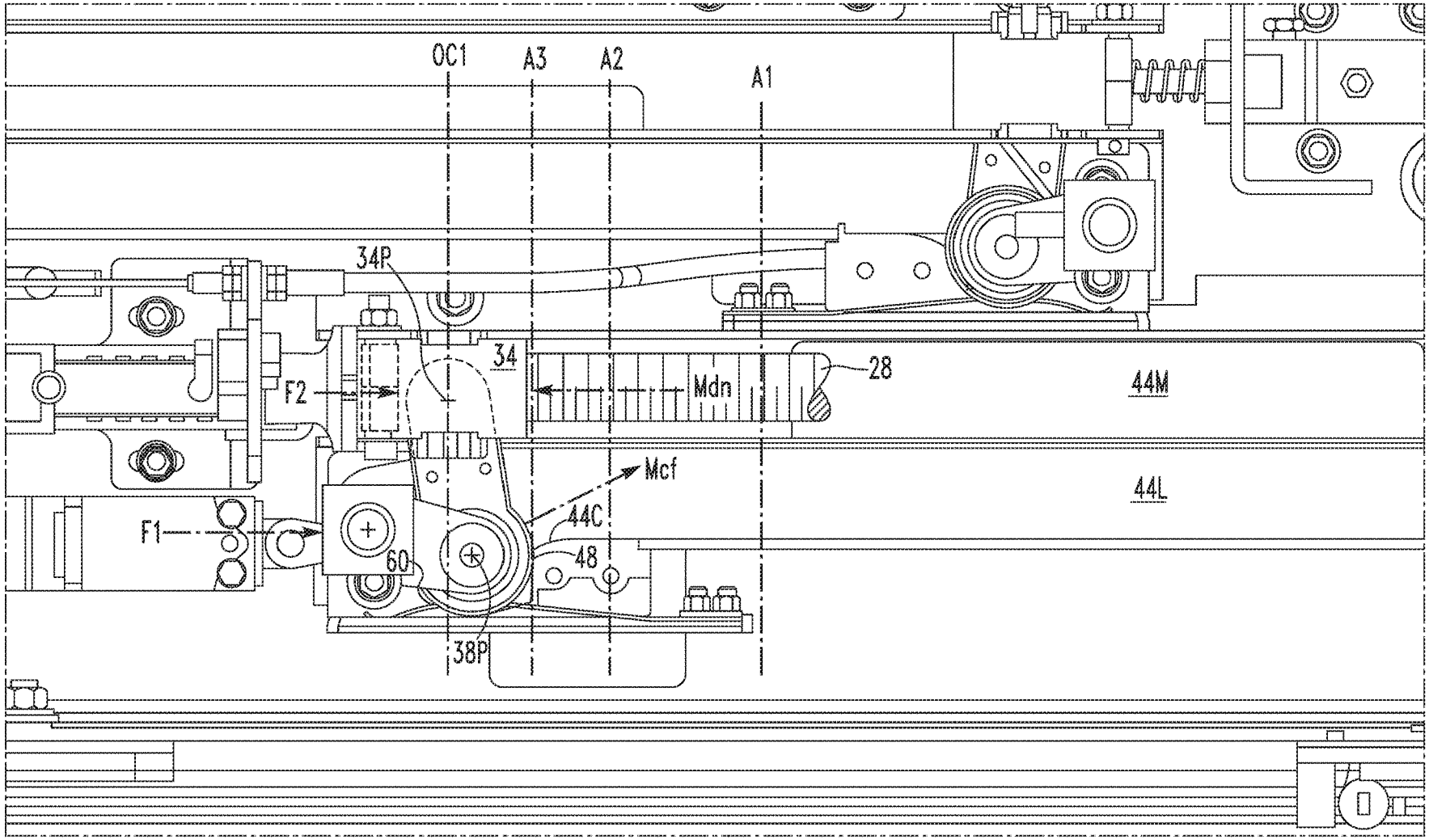
FIG. 7 is a partial view of the door operator system of FIG. 2 in a closed and fully locked condition.

With reference to FIGS. 5-7, operation of the first and second locking systems, to secure the track-engaging cam followers 46, 48 and thereby the drive brackets 70, 72 and doors 12, 14 in the locked position, will now be described. FIGS. 5-7 particularly illustrate the operation of the second (slave side) locking system. It is to be appreciated that the first locking system is identical and synchronous to the second locking system.

As shown in FIG. 5, as the drive bracket 70, 72 (not shown in FIG. 5) approaches the door closed position, the track-engaging cam follower 46, 48 nears the curved portion 42C, 44C of the respective first track 42L, 44L while the drive nut 32, 34 is not yet at the ends of its linear travel along the drive screw 26, 28. From that point, further motion of the drive nut 32, 34 will cause the cam-follower drive arm 36, 38 and the locking arm 50, 52 to rotate together about the driven pivot 36P, 38P. This motion is guided by the curved portion 42C, 44C of the first track 42L, 44L and the track end bumper 62, 64.

As shown in FIG. 6, as the drive bracket 70, 72 (not shown in FIG. 6) reaches the door closed position and the track-engaging cam follower 46, 48 moves toward a locked position, motion of the track-engaging cam follower 46, 48 is guided by the curved portion 42C, 44C of the first track 42L, 44L and the track end bumper 62, 64 and causes rotation of the cam-follower drive arm 36, 38 about the driving pivot 32P, 34P. At the end of this segment of motion, the trailing edge of the drive nut 32, 34 has moved from the longitudinal position marked by line A1 to the longitudinal position marked by line A2 while the trailing edge of the drive arm link 54, 56 has moved a shorter distance from the longitudinal position marked by line B1 to the longitudinal position marked by line B2. According to the state of the locking systems illustrated in FIG. 6, the leading edges of the door panels 12, 14 would be mated and the seals (not shown) compressed by the force applied to the track-engaging cam followers 46, 48 resting against the curved portions 42C, 44C of the first tracks 42L, 44L. In the course of its linear motion, the driven pivot 36P, 38P defined on the cam-follower drive arm 36, 38 and at least a center of the track-engaging cam follower 46, 48 cross an overcenter plane OC2 defined parallel to the first track 42L, 44L extending along a surface of the first track 42L, 44L. Beyond this point, the doors 12, 14 will be partially locked by a first overcenter lock effect.

As shown in FIG. 7, when the locking system reaches its end position, the track-engaging cam follower 46, 48 becomes engaged in a fully locked position. The trailing edge of the drive nut 32, 34 has moved from the longitudinal position marked by line A2 to the longitudinal position marked by line A3 while the position of the drive arm link 54, 56 has not appreciably changed, thereby causing the driven pivot 36P, 38P and at least a center of the track-engaging cam follower 46, 48 to cross an overcenter plane OC1 extending perpendicular to the set of tracks 42L, 42M, 44L, 44M and through the pivotal the driving pivot 32P, 34P defined on the drive nut 32, 34, which provides a second overcenter locking effect.

Accordingly, when the drive bracket 70, 72 is in the door closed position, the curved portion 42C, 44C of the first track 42L, 44L engages the track-engaging cam follower 46, 48 such that the track-engaging cam follower 46, 48 is retained in a locked position that is overcenter with respect to a first overcenter plane OC1 perpendicular to the set of tracks 42L, 42M, 44L, 44M extending through a pivotal connection 32P, 34P between the cam-follower drive arms 36, 38 linearly driven members 32, 34 and with respect to a second overcenter plane OC2 parallel to the set of tracks 42L, 42M, 44L, 44M extending along a surface of the first track 42L, 42M.

According to the example shown in FIGS. 3-7, the above-described first and second overcenter locking effects guard against unlocking and opening of the doors 12, 14 due to a force applied to the doors 12, 14 in the direction of opening or due to vibrations or jerking of the doors 12, 14. As shown in FIG. 7, any force F1 applied to the door panel 12, 14 in the opening direction will cause the track-engaging cam follower 46, 48 to move along direction Mcf, guided by the curved portion 42C, 44C of the first track 42L, 44L. In turn, this motion will cause the drive nut 32, 34 to move along direction Mdn. However, this movement of the drive nut 32, 34 is restricted or prevented by the track end bumper 62, 64 exerting an opposing reaction force F2. Thus, the track-engaging cam follower 46, 48 remains engaged in the locked position.

According the example shown in FIGS. 3-7, the drive screws 26, 28 and the curved portions 42C, 44C of the first tracks 42L, 44L are configured such that one turn or approximately one turn of the master drive screw 26 and the slave drive screw 28 by the motor 24 drives each of the track-engaging cam followers 46, 48 to travel along the respective curved portion 42C, 44C from a position at the top of the respective curved portion 42C, 44C (shown in FIG. 5) to a position that is overcenter with respect to the second overcenter plane OC2 (shown in FIG. 6). During this movement, the drive nuts 32, 34 travel the linear distance between the positions of lines A1 and A2. This travel distance sets the torque required to be delivered by the motor 24 to push the track-engaging cam followers 46, 48 against the ends of the respective curved portions 42C, 44C of the first tracks 42L, 44L and to compress the seals on the leading edges of the doors 12, 14. This torque is largely reduced as compared to a system wherein the motion of locking system had to be accomplished in a fraction of rotation.

Additionally with reference to FIG. 8, the cam-follower drive arms 36, 38 are identical for both the first and second locking systems. The roller 80, 82 is coaxially connected to the first end of the cam-follower drive arm 36, 38 where it is connected to the driving pivot 32P, 34P. The track-engaging cam follower 46, 48 is coaxially connected to the driven pivot 36P, 38P on the second end of the track-engaging cam follower 46, 48. Both the roller 80, 82 and the track-engaging cam follower 46, 48 are free to rotate about their respective pivotal connections 32P, 34P, 36P, 38P. As discussed above, a spur 36C, 38C are located on the second end of the cam-follower drive arm 36, 38.

With reference to FIG. 9, the roller 80 is shown engaged with the second track 42M of the first set of tracks 42L, 42M. The cam-follower drive arm 36 is connected to the roller 80 and the drive nut 32 through the pivotal connection/driving pivot 32P. The track-engaging cam follower 46 is engaged in the first track 42L. The cam-follower drive arm 36 is attached to the track-engaging cam follower 46 and the locking arm 50 through the pivotal connection/driven pivot 36P.

With reference to FIG. 10, the second cam-follower drive arm 38 is shown when the second track-engaging cam follower 48 is in the locked position with the spur 38C resting against the second abutment 92. The second track-engaging cam follower 48 is pushed against the second spring 60. The reaction force of the spring 60 applies force on the track-engaging cam follower 48 to maintain the track-engaging cam follower 48 in the locked position with respect to the first and second overcenter planes OC1, OC2. Whenever a force F1 (as shown in FIG. 7) is applied to the locking system, the spur 38C rests against the abutment 92 in order to provide further structural strength to the locking system.

With reference to FIGS. 2-10, to unlock and open the doors 12, 14, the drive nuts 32, 34 are driven in an opening direction by a reverse drive applied by the motor 24. This reverses the motion of the locking systems in a sequentially reverse manner from the state shown in FIG. 7 to the state shown in FIG. 6 and then to the state shown in FIG. 5 and beyond until the drive brackets 70, 72 and the doors 12, 14 reach an open position.

As discussed above, it is to be appreciated that the door operator system 22 may be provided to open and close and lock a single door 12. In such an example, the door operator system 22 would be provided with a drive system that includes the motor 24, the first drive screw 26, and the first linearly driven member/drive nut 32, as well as any other components of the master portion of the drive system described above, and with a single locking system that includes a cam-follower drive arm 36, a track-engaging cam follower 46, and a locking arm 50, as well as any other components of the first locking system described above.

Further examples of the present disclosure will now be described in the following number clauses.

Clause 1: A door operator system (22) for moving a door (12) of a transit vehicle (10) along a door opening (18) between open and closed positions, the door operator system (22) comprising: a base (40) configured to be mounted on the transit vehicle (10) above the door opening (18), the base (40) comprising a first set of tracks (42L, 42M) defined therein, a first track (42L) of the first set of tracks (42L, 42M) having a curved portion (42C) at an end thereof; a drive bracket (70) slidably mounted on the first set of tracks (42L, 42M) of the base (40), the drive bracket (70) being configured to suspend the door (12) from the base (40), the drive bracket (70) being slidably movable along the first set of tracks (42L, 42M) between a door open position and a door closed position adjacent to the curved portion (42C) of the first track (42L); a drive system disposed on the base (40), the drive system comprising: a linear drive mechanism (24, 26) configured to be activated to cause movement of the drive bracket (70) between the door open position and the door closed position; and a linearly driven member (32) connected to the linear drive mechanism (24, 26) to be driven by the linear drive mechanism (24, 26) in opposing directions along a second track (42M) of the first set of tracks (42L, 42M), the linearly driven member (32) being operably connected to the drive bracket (70); a locking system connecting the drive bracket (70) to the linearly driven member (32) and configured to retain the drive bracket (70) in the door closed position, the locking system comprising: a cam-follower drive arm (36) pivotably connected to the linearly driven member (32) at a first end of the cam-follower drive arm (36); a track-engaging cam follower (46) connected to a second end of the cam-follower drive arm (36), the track-engaging cam follower (46) being movably disposed in the first track (42L) of the first set of tracks (42L, 42M) to be movable along the first track (42L); and a locking arm (50) pivotably connected to the second end of the cam-follower drive arm (36), the locking arm (50) being operatively connected to the drive bracket (70), wherein when the drive bracket (70) is in the door closed position, the curved portion (42C) of the first track (42L) of the first set of tracks (42L, 42M) engages the track-engaging cam follower (46) such that the track-engaging cam follower (46) is retained in a locked position that is overcenter with respect to a first overcenter plane (OC1) perpendicular to the first set of tracks (42L, 42M) extending through a pivotal connection (32P) between the cam-follower drive arm (36) and the linearly driven member (32) and with respect to a second overcenter plane (OC2) parallel to the first set of tracks (42L, 42M) extending along a surface of the first track (42L) of the first set of tracks (42L, 42M).

Clause 2: The door operator system according to clause 1, wherein the track-engaging cam follower (46) comprises a roller engaging the first track (42L) of the first set of tracks (42L, 42M).

Clause 3: The door operator system according to clauses 1 or 2, wherein the drive system further comprises a roller (80) engaging the second track (42M) of the first set of tracks (42L, 42M), the roller (80) being connected to the cam-follower drive arm (36) and the linearly driven member (32) at the pivotal connection (32P).

Clause 4: The door operator system according to any one of clauses 1-3, wherein the locking system further comprises a spring (58) positioned at an end of the curved portion (42C) of the first track (42L) of the first set of tracks (42L, 42M), the spring (58) being configured to engage the track-engaging cam follower (46) when the drive bracket (70) is in the door closed position to bias the track-engaging cam follower (46) toward the curved portion (42C) and the locked position.

Clause 5: The door operator system according to any one of clauses 1-4, wherein the locking system further comprises a track end bumper (62) positioned proximate to the curved portion (42C) of the first track (42L) of the first set of tracks (42L, 42M), the track end bumper (62) being configured to engage the track-engaging cam follower (46) to cause the track-engaging cam follower (46) to travel along the curved portion (42C) to the locked position as the drive bracket (70) approaches the door closed position and to retain the track-engaging cam follower (46) in the locked position.

Clause 6: The door operator system according to any one of clauses 1-5, wherein the cam-follower drive arm (36) comprises a spur (36C) at the second end thereof and the locking system further comprises an abutment (90) disposed adjacent to the curved end (42C) of the first track (42L), and wherein the spur (36C) engages the abutment (90) when the track-engaging cam follower (46) is in the locked position to retain the track-engaging cam follower (46) in the locked position.

Clause 7: The door operator system according to any one of clauses 1-6, wherein the linear drive mechanism comprises: a motor (24); and a drive screw (26) having a rotary power connection to the motor (24), at least one of the motor (24) and the drive screw (26) being mounted on the base (40), and wherein the linearly driven member comprises a drive nut (32) engaging the drive screw (26) to be driven by the drive screw (26) such that rotation of the drive screw (26) imparts linear motion to the drive nut (32).

Clause 8: The door operator system according to clause 7, wherein the drive screw (26) and the curved portion (42C) of the first track (42L) are configured such that one turn of the drive screw (26) by the motor (24) drives the track-engaging cam follower (46) to travel along the curved portion (42C) from a position at a top of the curved portion (42C) to a position that is overcenter with respect to the second overcenter plane (OC2).

Clause 9: The door operator system according to any one of clauses 1-8, wherein the locking system further comprises a drive arm link (54) that connects the drive bracket (70) to the locking arm (50), and wherein the drive arm link (54) is driven by the drive system to move along a line parallel to the first set of tracks (42L, 42M).

Clause 10: The door operator system according to any one of clauses 1-9, wherein the door operator system (22) is configured to move a pair of doors (12, 14) of the transit vehicle (10) in opposing directions along the door opening (18) between respective open and closed positions.

Clause 11: The door operator system according to clause 10, wherein the base further comprises a second set of tracks (44L, 44M) defined therein, a first track (44L) of the second set of tracks (44L, 44M) having a curved portion (44C) at an end thereof, wherein a second drive bracket (72) is slidably mounted on the second set of tracks (44L, 44M) of the base, the second drive bracket (72) being configured to suspend a second door (14) from the base (40), and the second drive bracket (72) being slidably movable along the second set of tracks (44L, 44M) between a door open position and a door closed position adjacent to the curved portion (44C) of the first track (44L) of the second set of tracks (44L, 44M), wherein the drive system further comprises a slave drive mechanism (30, 28) configured to be actuated by the linear drive mechanism (24, 26) to cause movement of the second drive bracket (72) between the door open position and the door closed position and a second linearly driven member (34) connected to the slave drive mechanism (30, 28) to be driven by the slave drive mechanism (30, 28) in opposing directions along a second track (44M) of the second set of tracks (44L, 44M), the second linearly driven member (34) being operably connected to the second drive bracket (72), wherein a second locking system connects the second drive bracket (72) to the second linearly driven member (34) and is configured to retain the second drive bracket (72) in the door closed position, wherein the second locking system comprises: a second cam-follower drive arm (38) pivotably connected to the second linearly driven member (34) at a first end of the second cam-follower drive arm (38); a second track-engaging cam follower (48) connected to a second end of the second cam-follower drive arm (38), the second track-engaging cam follower (48) being movably disposed in the first track (44L) of the second set of tracks (44L, 44M) to be movable along the first track (44L); and a second locking arm (52) pivotably connected to the second end of the second cam-follower drive arm (38), the second locking arm (52) being operatively connected to the second drive bracket (72), and wherein when the second drive bracket (72) is in the door closed position, the curved portion (44C) of the first track (44L) of the second set of tracks (44L, 44M) engages the second track-engaging cam follower (48) such that the second track-engaging cam follower (48) is retained in a locked position that is overcenter with respect to a first overcenter plane (OC1) perpendicular to the second set of tracks (44L, 44M) extending through a pivotal connection point (34P) between the second cam-follower drive arm (38) and the second linearly driven member (34) and with respect to a second overcenter plane (OC2) parallel to the second set of tracks (44L, 44M) extending along a surface of the first track (44L) of the second set of tracks (44L, 44M).

Clause 12: The door operator system according to clause 11, wherein the slave drive mechanism (30, 28) comprises a master to slave drive gear train (30) and a slave drive screw (28), at least one of the master to slave drive gear train (30) and the slave drive screw (28) being mounted on the base (40), wherein the master to slave drive gear train (30) is connected to the linear drive mechanism (24, 26) and the slave drive screw (28) is connected to the master to slave drive gear train (30) such that activation of the linear drive mechanism (24, 26) actuates rotation of the slave drive screw (28) via the master to slave drive gear train (30), and wherein the second linearly driven member comprises a second drive nut (34) engaging the slave drive screw (28) to be driven by the slave drive screw (28) such that rotation of the slave drive screw (28) imparts linear motion to the second drive nut (34).

Clause 13: A door operator system (22) for moving a pair of doors (12, 14) of a transit vehicle (10) in opposing directions along a door opening (18) between open and closed positions, the door operator system (22) comprising: a base (40) configured to be mounted on the transit vehicle (10) above the door opening (18), the base (40) comprising a first set of tracks (42L, 42M) and a second set of tracks (44L, 44M) defined therein, a first track (42L) of the first set of tracks (42L, 42M) having a first curved portion (42C) at an end thereof and a first track (44L) of the second set of tracks (44L, 44M) having a second curved portion (44C) formed at an end thereof; a first drive bracket (70) slidably mounted on the first set of tracks (42L, 42M) and a second drive bracket (72) slidably mounted on the second set of tracks (44L, 44M), each the drive brackets (70, 72) being configured to suspend a respective one of the doors (12, 14) from the base (40), the first drive bracket (70) being slidably movable along the first set of tracks (42L, 42M) and the second drive bracket (72) being slidably movable along the second set of tracks (44L, 44M) between respective door open positions and respective door closed positions adjacent to a respective one of the curved portions (42C, 44C) of the respective first tracks (42L, 44L); a drive system disposed on the base (40), the drive system comprising: a linear drive mechanism (24, 26, 30, 28) configured to be activated to cause movement of the drive brackets (70, 72) between the door open positions and the door closed positions; and a first linearly driven member (32) and a second linearly driven member (34) connected to the linear drive mechanism (24, 26, 30, 28) to be driven by the linear drive mechanism (24, 26, 30, 28) in opposing directions along a respective second track (42M, 44M) of the first and second set of tracks (42L, 42M, 44L, 44M), the linearly driven members (32, 34) being operably connected to a respective one of the drive brackets (70, 72); a first locking system connecting the first drive bracket (70) to the first linearly driven member (32) and configured to retain the first drive bracket (70) in the door closed position and a second locking system connecting the second drive bracket (72) to the second linearly driven member (34) and configured to retain the second drive bracket (72) in the door closed position, each of the first and second locking systems comprising: a cam-follower drive arm (36, 38) pivotably connected to the respective linearly driven member (32, 34) at a first end of the cam-follower drive arm (36, 38); a track-engaging cam follower (46, 48) connected to a second end of the respective cam-follower drive arm (36, 38), the track-engaging cam follower (46, 48) being movably disposed in respective first track (42L, 44L) to be movable along the respective first track (42L, 44L); and a locking arm (50, 52) pivotably connected to the second end of the respective cam-follower drive arm (36, 38), the locking arm (50, 52) being operably connected to the respective drive bracket (70, 72), wherein when the respective drive bracket (70, 72) is in the door closed position, the respective curved portion (42C, 44C) of the respective first track (42L, 44L) engages the respective track-engaging cam follower (46, 48) such that the respective track-engaging cam follower (46, 48) is retained in a locked position that is overcenter with respect to a first overcenter plane (OC1) perpendicular to the respective set of tracks (42L, 42M, 44L, 44M) extending through a respective pivotal connection (32P, 34P) between the respective cam-follower drive arm (36, 38) and the respective linearly driven member (32, 34) and with respect to a second overcenter plane (OC2) parallel to the respective set of tracks (42L, 42M, 44L, 44M) extending along a surface of the respective first track (42L, 44L).

Clause 14: The door operator system according to clause 13, wherein each track-engaging cam follower (46, 48) comprises a roller engaging the respective first track (42L, 44L).

Clause 15: The door operator system according to clause 13 or clause 14, wherein the drive system further comprises a first roller (80) engaging the second track (42M) of the first set of tracks (42L, 42M) and a second roller (82) engaging the second track (44M) of the second set of tracks (44L, 44M), each roller (80, 82) being connected to the respective cam-follower drive arm (36, 38) and the respective linearly driven member (32, 34) at the respective pivotal connection (32P, 34P).

Clause 16: The door operator system according to any one of clauses 13-15, wherein each of the first and second locking systems further comprises a spring (58, 60) positioned at an end of the respective curved portion (42C, 44C) of the respective first track (42L, 44L), each spring (58, 60) being configured to engage the respective track-engaging cam follower (46, 48) when the respective drive bracket (70, 72) is in the door closed position to bias the respective track-engaging cam follower (46, 48) toward the respective curved portion (42C, 44C) and the locked position.

Clause 17: The door operator system according to any one of clauses 13-16, wherein each of the first and second locking systems further comprises a track end bumper (62, 64) proximate to the respective curved portion (42C, 44C) of the respective first track (42L, 44L), the track end bumper (62, 64) being configured to engage the respective track-engaging cam follower (46, 48) to cause the respective track-engaging cam follower (46, 48) to travel along the respective curved portion (42C, 44C) to the locked position as the respective drive bracket (70, 72) approaches the door closed position and to retain the respective track-engaging cam follower (46, 48) in the locked position.

Clause 18: The door operator system according to any one of clauses 13-17, wherein each cam-follower drive arm (36, 38) comprises a spur (36C, 38C) at the second end thereof and each of the first and second locking systems further comprises an abutment (90, 92), and wherein the spur engages the respective abutment when the respective track-engaging cam follower (46, 48) is in the locked position to retain the respective track-engaging cam follower (46, 48) in the locked position.

Clause 19: The door operator system according to any one of clauses 13-18, wherein the linear drive mechanism comprises: a motor (24); a drive screw (26) having a rotary power connection to the motor (24); a master to slave drive gear train (30) connected to the drive screw (26); and a slave drive screw (28) connected to the master to slave drive gear train (30), at least one of the motor (24) and the drive screw (26) being mounted on the base (40) and at least one of the master to slave drive gear train (30) and the slave drive screw (28) being mounted on the base (40), wherein the master to slave drive gear train (30) is connected to the drive screw (26) and the slave drive screw (28) is connected to the master to slave drive gear train (30) such that activation of the motor (24) actuates rotation of the slave drive screw (28) via the master to slave drive gear train (30), and wherein each of the first and second linearly driven members comprises a drive nut (32, 34) engaging a respective one of the drive screw (26) and the slave drive screw (28) such rotation of the respective drive screw (26, 28) imparts linear motion to the drive nut (32, 34).

Clause 20: The door operator system according to clause 19, wherein the drive screw (26) and the slave drive screw (28) and the curved portions (42C, 44C) of the respective first tracks (42L, 44L) are configured such that one turn of the drive screw (26) and the slave drive screw (28) by the motor (24) drives each of the track-engaging cam followers (46, 48) to travel along the respective curved portion (42C, 44C) from a position at a top of the respective curved portion (42C, 44C) to a position that is overcenter with respect to the second overcenter plane (OC2).

Clause 21: The door operator system according to any one of clauses 13-20, wherein each of the first and second locking systems further comprises a drive arm link (54, 56) that connects the respective drive bracket (70, 72) to the respective locking arm (50, 52), and wherein each drive arm link (54, 56) is driven by the drive system to move along a line parallel to a respective one of the first and second set of tracks (42L, 42M, 44L, 44M).

Clause 22: A door assembly for a transit vehicle (10) having a door opening (18) formed in a wall (20) of the transit vehicle (10), the door assembly comprising: a pair of doors (12, 14) disposed adjacent to the wall (20); and a door operator system (22) according to any one of clauses 13-21, the door operator system (22) being configured to move the pair of doors (12, 14) in opposing directions along the door opening (18) between open and closed positions.

Clause 23: The door assembly according to clause 22, wherein the door operator system (22) is disposed on the wall (20) of the transit vehicle (10) above the door opening (18).

Clause 24: A door operator system (22) for moving a door (12) of a transit vehicle (10) along a door opening (18) between open and closed positions, the door operator system (22) comprising: a base (40) comprising a track (42L) defined therein, the track (42L) having a curved portion (42C) at an end thereof; a drive bracket (70) slidably mounted to the track (42L), the drive bracket (70) being configured to suspend the door (12) from the base (40), the drive bracket being slidably movable along the track (42L) between an door open position and door closed position adjacent to the curved portion (42C); a linear drive mechanism (24, 26) operably connected to the drive bracket (70), the linear drive mechanism (24, 26) being configured to be activated to cause movement of the drive bracket (70) between the door open position and the door closed position; and a locking system (36, 46, 50, 54) connecting the drive bracket (70) to the linear drive mechanism (24, 26) and configured to retain the drive bracket (70) in the door closed position, wherein when the drive bracket (70) is in the door closed position, the curved portion (42C) of the track (42L) engages a track-engaging cam follower (46) of the locking system (36, 46, 50, 54) such that the track-engaging cam follower (46) is retained in a locked position that is overcenter with respect to a first overcenter plane (OC1) perpendicular to the track (42L) extending through a connection (32P) between the locking system (36, 46, 50, 54) and the linear drive mechanism (24, 26) and with respect to a second overcenter plane (OC2) parallel to the track (42L) extending along a surface of the track (42L).

Clause 25: The door operator system (22) according to clause 24, wherein the track-engaging cam follower (46) comprises a roller engaging the track (42L).

Clause 26: The door operator system according to clause 24 or clause 25, wherein the locking system further comprises a spring (58) positioned at an end of the curved portion (42C) of the track (42L), the spring (58) being configured to engage the track-engaging cam follower (46) when the drive bracket (70) is in the door closed position to bias the track-engaging cam follower (46) toward the curved portion (42C) and the locked position.

Clause 27: The door operator system according to any one of clauses 24-26, wherein the locking system further comprises a track end bumper (62) positioned proximate to the curved portion (42C) of the track (42L), the track end bumper (62) being configured to engage the track-engaging cam follower (46) to cause the track-engaging cam follower (46) to travel along the curved portion (42C) to the locked position as the drive bracket (70) approaches the door closed position and to retain the track-engaging cam follower (46) in the locked position.

It is to be understood that the invention may assume various alternative variations and step sequences, except where expressly specified to the contrary. It is also to be understood that the specific devices and processes illustrated in the attached drawings, and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that, to the extent possible, one or more features of any embodiment or aspect can be combined with one or more features of any other embodiment or aspect.

The invention claimed is:

1. A door operator system comprising:

a base configured to be mounted on a vehicle above a door opening, the base comprising a first set of tracks defined therein, a first track of the first set of tracks having a curved portion at an end thereof;

a drive bracket slidably mounted on the first set of tracks of the base, the drive bracket being configured to suspend the door from the base, the drive bracket being slidably movable along the first set of tracks between a door open position and a door closed position adjacent to the curved portion of the first track;

a drive system disposed on the base, the drive system comprising:

a linear drive mechanism configured to be activated to cause movement of the drive bracket between the door open position and the door closed position; and a linearly driven member connected to the linear drive mechanism to be driven by the linear drive mechanism in opposing directions along a second track of the first set of tracks, the linearly driven member being operably connected to the drive bracket; and a locking system connecting the drive bracket to the linearly driven member and configured to retain the drive bracket in the door closed position, the locking system comprising:

a cam-follower drive arm pivotably connected to the linearly driven member at a first end of the cam-follower drive arm;

a track-engaging cam follower connected to a second end of the cam-follower drive arm, the track-engaging cam follower being movably disposed in the first track of the first set of tracks to be movable along the first track; and a locking arm pivotably connected to the second end of the cam-follower drive arm, the locking arm being operatively connected to the drive bracket, wherein when the drive bracket is in the door closed position, the curved portion of the first track of the first set of tracks engages the track-engaging cam follower such that the track-engaging cam follower is retained in a locked position that is over center with respect to a first over center plane perpendicular to the first set of tracks extending through a pivotal connection between the cam-follower drive arm and the linearly driven member and with respect to a second over center plane parallel to the first set of tracks extending along a surface of the first track of the first set of tracks.

2. The door operator system according to claim 1, wherein the track-engaging cam follower comprises a roller engaging the first track of the first set of tracks.

3. The door operator system according to claim 1, wherein the drive system further comprises a roller engaging the second track of the first set of tracks, the roller being connected to the cam-follower drive arm and the linearly driven member at the pivotal connection.

4. The door operator system according to claim 1, wherein the locking system further comprises a spring positioned at an end of the curved portion of the first track of the first set of tracks, the spring being configured to engage the track-engaging cam follower when the drive bracket is in the door closed position to bias the track-engaging cam follower toward the curved portion and the locked position.

5. The door operator system according to claim 1, wherein the locking system further comprises a track end bumper positioned proximate to the curved portion of the first track of the first set of tracks, the track end bumper being configured to engage the track-engaging cam follower to cause the track-engaging cam follower to travel along the curved portion to the locked position as the drive bracket approaches the door closed position and to retain the track-engaging cam follower in the locked position.

6. The door operator system according to claim 1, wherein the cam-follower drive arm comprises a spur at the second end thereof and the locking system further comprises an abutment disposed adjacent to the curved end of the first track, and wherein the spur engages the abutment when the track-engaging cam follower is in the locked position to retain the track-engaging cam follower in the locked position.

7. The door operator system according to claim 1, wherein the linear drive mechanism comprises: a motor; and a drive screw having a rotary power connection to the motor, at least one of the motor and the drive screw being mounted on the base, and wherein the linearly driven member comprises a drive nut engaging the drive screw to be driven by the drive screw such that rotation of the drive screw imparts linear motion to the drive nut.

8. The door operator system according to claim 7, wherein the drive screw and the curved portion of the first track are configured such that one turn of the drive screw by the motor drives the track-engaging cam follower to travel along the curved portion from a position at a top of the curved portion to a position that is over center with respect to the second over center plane.

9. The door operator system according to claim 1, wherein the locking system further comprises a drive arm link that connects the drive bracket to the locking arm, and wherein the drive arm link is driven by the drive system to move along a line parallel to the first set of tracks.

10. The door operator system according to claim 1, wherein the door operator system is configured to move a pair of doors of the vehicle in opposing directions along the door opening between respective open and closed positions.

11. The door operator system according to claim 10, wherein the base further comprises a second set of tracks defined therein, a first track of the second set of tracks having a curved portion at an end thereof, wherein a second drive bracket is slidably mounted on the second set of tracks of the base, the second drive bracket being configured to suspend a second door from the base, and the second drive bracket being slidably movable along the second set of tracks between a door open position and a door closed position adjacent to the curved portion of the first track of the second set of tracks, wherein the drive system further comprises a slave drive mechanism configured to be actuated by the linear drive mechanism to cause movement of the second drive bracket between the door open position and the door closed position and a second linearly driven member connected to the slave drive mechanism to be driven by the slave drive mechanism in opposing directions along a second track of the second set of tracks, the second linearly driven member being operably connected to the second drive bracket, wherein a second locking system connects the second drive bracket to the second linearly driven member and is configured to retain the second drive bracket in the door closed position, wherein the second locking system comprises: a second cam-follower drive arm pivotably connected to the second linearly driven member at a first end of the second cam-follower drive arm; a second track-engaging cam follower connected to a second end of the second cam-follower drive arm, the second track-engaging cam follower being movably disposed in the first track of the second set of tracks to be movable along the first track; and a second locking arm pivotably connected to the second end of the second cam-follower drive arm, the second locking arm being operatively connected to the second drive bracket, and wherein when the second drive bracket is in the door closed position, the curved portion of the first track of the second set of tracks engages the second track-engaging cam follower such that the second track-engaging cam follower is retained in a locked position that is over center with respect to a first over center plane perpendicular to the second set of tracks extending through a pivotal connection point between the second cam-follower drive arm and the second linearly driven member and with respect to a second over center plane parallel to the second set of tracks extending along a surface of the first track of the second set of tracks.

12. The door operator system according to claim 11, wherein the slave drive mechanism comprises a master to slave drive gear train and a slave drive screw, at least one of the master to slave drive gear train and the slave drive screw being mounted on the base, wherein the master to slave drive gear train is connected to the linear drive mechanism and the slave drive screw is connected to the master to slave drive gear train such that activation of the linear drive mechanism actuates rotation of the slave drive screw via the master to slave drive gear train, and wherein the second linearly driven member comprises a second drive nut engaging the slave drive screw to be driven by the slave drive screw such that rotation of the slave drive screw imparts linear motion to the second drive nut.

13. A door operator system comprising:

a base configured to be mounted on a vehicle above a door opening, the base comprising a first set of tracks and a second set of tracks defined therein, a first track of the first set of tracks having a first curved portion at an end thereof and a first track of the second set of tracks having a second curved portion formed at an end thereof;

a first drive bracket slidably mounted on the first set of tracks and a second drive bracket slidably mounted on the second set of tracks, each the drive brackets being configured to suspend a respective one of the doors from the base, the first drive bracket being slidably movable along the first set of tracks and the second drive bracket being slidably movable along the second set of tracks between respective door open positions and respective door closed positions adjacent to a respective one of the curved portions of the respective first tracks;

a drive system disposed on the base, the drive system comprising:

a linear drive mechanism configured to be activated to cause movement of the drive brackets between the door open positions and the door closed positions; and a first linearly driven member and a second linearly driven member connected to the linear drive mechanism to be driven by the linear drive mechanism in opposing directions along a respective second track of the first and second set of tracks, the linearly driven members being operably connected to a respective one of the drive brackets;

a first locking system connecting the first drive bracket to the first linearly driven member and configured to retain the first drive bracket in the door closed position and a second locking system connecting the second drive bracket to the second linearly driven member and configured to retain the second drive bracket in the door closed position, each of the first and second locking systems comprising:

a cam-follower drive arm pivotably connected to the respective linearly driven member at a first end of the cam-follower drive arm;

a track-engaging cam follower connected to a second end of the respective cam-follower drive arm, the track-engaging cam follower being movably disposed in respective first track to be movable along the respective first track; and a locking arm pivotably connected to the second end of the respective cam-follower drive arm, the locking arm being operably connected to the respective drive bracket, wherein when the respective drive bracket is in the door closed position, the respective curved portion of the respective first track engages the respective track-engaging cam follower such that the respective track-engaging cam follower is retained in a locked position that is over center with respect to a first over center plane perpendicular to the respective set of tracks extending through a respective pivotal connection between the respective cam-follower drive arm and the respective linearly driven member and with respect to a second over center plane parallel to the respective set of tracks extending along a surface of the respective first track.

14. The door operator system according to claim 13, wherein each track-engaging cam follower comprises a roller engaging the respective first track.

15. The door operator system according to claim 13, wherein the drive system further comprises a first roller engaging the second track of the first set of tracks and a second roller engaging the second track of the second set of tracks, each roller being connected to the respective cam-follower drive arm and the respective linearly driven member at the respective pivotal connection.

16. The door operator system according to claim 13, wherein each of the first and second locking systems further comprises a spring positioned at an end of the respective curved portion of the respective first track, each spring being configured to engage the respective track-engaging cam follower when the respective drive bracket is in the door closed position to bias the respective track-engaging cam follower toward the respective curved portion and the locked position.

17. The door operator system according to claim 13, wherein each of the first and second locking systems further comprises a track end bumper proximate to the respective curved portion of the respective first track, the track end bumper being configured to engage the respective track-engaging cam follower to cause the respective track-engaging cam follower to travel along the respective curved portion to the locked position as the respective drive bracket approaches the door closed position and to retain the respective track-engaging cam follower in the locked position.

18. The door operator system according to claim 13, wherein each cam-follower drive arm comprises a spur at the second end thereof and each of the first and second locking systems further comprises an abutment, and wherein the spur engages the respective abutment when the respective track-engaging cam follower is in the locked position to retain the respective track-engaging cam follower in the locked position.

19. The door operator system according to claim 13, wherein the linear drive mechanism comprises: a motor; a drive screw having a rotary power connection to the motor; a master to slave drive gear train connected to the drive screw; and a slave drive screw connected to the master to slave drive gear train, at least one of the motor and the drive screw being mounted on the base and at least one of the master to slave drive gear train and the slave drive screw being mounted on the base, wherein the master to slave drive gear train is connected to the drive screw and the slave drive screw is connected to the master to slave drive gear train such that activation of the motor actuates rotation of the slave drive screw via the master to slave drive gear train, and wherein each of the first and second linearly driven members comprises a drive nut engaging a respective one of the drive screw and the slave drive screw such rotation of the respective drive screw imparts linear motion to the drive nut.

20. The door operator system according to claim 19, wherein the drive screw and the slave drive screw and the curved portions of the respective first tracks are configured such that one turn of the drive screw and the slave drive screw by the motor drives each of the track-engaging cam followers to travel along the respective curved portion from a position at a top of the respective curved portion to a position that is over center with respect to the second over center plane.

21. The door operator system according to claim 13, wherein each of the first and second locking systems further comprises a drive arm link that connects the respective drive bracket to the respective locking arm, and wherein each drive arm link is driven by the drive system to move along a line parallel to a respective one of the first and second set of tracks.

22. A door assembly comprising:

a pair of doors disposed adjacent to a vehicle wall; and a door operator system according to claim 13, the door operator system being configured to move the doors in the pair in opposing directions along the door opening between open and closed positions.

23. The door assembly according to claim 22, wherein the door operator system is disposed on the wall of the vehicle above the door opening.

* * * * *